US005840189A

United States Patent [19]

Sylvan et al.

[11] Patent Number: 5,840,189

[45] Date of Patent: Nov. 24, 1998

[54] BEVERAGE FILTER CARTRIDGE

[75] Inventors: John E. Sylvan, Brookline; Peter B. Dragone, Concord, both of Mass.

[73] Assignee: Keurig, Inc., Waltham, Mass.

[21] Appl. No.: 914,955

[22] Filed: Aug. 20, 1997

Related U.S. Application Data

[63] Continuation of Ser. No. 527,770, Sep. 13, 1995, abandoned, which is a continuation-in-part of Ser. No. 192,409, Feb. 4, 1994, abandoned, which is a division of Ser. No. 945,746, Sep. 16, 1992, Pat. No. 5,325,765.

[51] Int. Cl.[6] ..... B01D 27/00; B01D 29/085; B65B 29/02

[52] U.S. Cl. ..... 210/474; 210/233; 210/497.01; 210/497.3; 99/295; 99/302 R; 99/317; 426/77; 426/433; 426/435

[58] Field of Search ..... 426/77, 78, 79, 426/80, 81, 82, 473, 477, 479, 482, 435, 112, 433; 99/279, 295, 300, 302 R, 302 P, 304, 306, 307, 316, 317, 321; 210/473, 474, 484, 488, 492, 497.3, 233, 497.01

[56] References Cited

U.S. PATENT DOCUMENTS

| | | | |
|---|---|---|---|
| 240,402 | 4/1881 | Gee . | |
| 346,278 | 7/1886 | Halstead . | |
| 370,141 | 9/1887 | Hobbs . | |
| 845,968 | 3/1907 | Murray . | |
| 1,168,544 | 1/1916 | Newlin . | |
| 1,302,483 | 4/1919 | Vierling . | |
| 2,997,940 | 8/1961 | Pecoraro et al. . | |
| 3,144,495 | 8/1964 | Makowski | 264/248 |
| 3,199,682 | 8/1965 | Scholtz . | |
| 3,579,351 | 5/1971 | Wege et al. . | |
| 3,615,708 | 10/1971 | Abile-Gal . | |
| 3,812,273 | 5/1974 | Schmidt . | |
| 3,971,305 | 7/1976 | Daswick . | |
| 4,136,202 | 1/1979 | Favre | 426/77 |
| 4,204,966 | 5/1980 | Morgan, Jr. . | |
| 4,321,139 | 3/1982 | Auclair . | |
| 4,389,925 | 6/1983 | Plana . | |
| 4,417,504 | 11/1983 | Yamamoto . | |
| 4,446,158 | 5/1984 | English et al. . | |
| 4,584,101 | 4/1986 | Kataoka . | |
| 4,818,544 | 4/1989 | Seward | 426/77 |
| 4,859,337 | 8/1989 | Woltermann . | |
| 4,860,645 | 8/1989 | van der Lijn et al. . | |
| 4,886,674 | 12/1989 | Seward et al. | 426/77 |
| 4,981,588 | 1/1991 | Poulallion . | |
| 4,995,310 | 2/1991 | van der Lijn et al. . | |
| 5,242,702 | 9/1993 | Fond | 426/77 |
| 5,325,765 | 7/1994 | Sylvan et al. | 426/77 |
| 5,424,083 | 6/1995 | Lozito | 426/77 |
| 5,472,719 | 12/1995 | Favre | 426/77 |

FOREIGN PATENT DOCUMENTS

| | | | |
|---|---|---|---|
| 1248283 | 11/1960 | France | 426/79 |
| 2556323 | 6/1985 | France | 426/77 |
| 2327264 | 1/1975 | Germany | 426/77 |

*Primary Examiner*—Robert J. Popovics
*Attorney, Agent, or Firm*—Samuels, Gauthier, Stevens & Reppert

[57] ABSTRACT

A beverage filter cartridge includes an impermeable yieldably pierceable base having a predetermined shape and an access opening at one end. A self-supporting wettable filter element is disposed in the base and is permanently sealed to an interior surface of the base. The filter element subdivides the base into first and second chambers, a first chamber for storing an extract of the beverage to be made, and a second empty chamber for accessing the beverage after the beverage outflow from the filter has been made by combining a liquid with the extract. An impermeable, yieldably pierceable, imperforate cover is sealingly engaged with the top of the base to form an impermeable cartridge.

6 Claims, 2 Drawing Sheets

BEVERAGE FILTER CARTRIDGE

CROSS REFERENCES TO RELATED APPLICATIONS

This is a continuation of application(s) Ser. No. 08/527,770 filed on Sep. 13, 1995 now abandoned, which is a continuation-in-part of Ser. No. 08/192,409 filed on Feb. 4, 1994, now abandoned, which is a divisional application of Ser. No. 07/945,746 filed on Sep. 16, 1992 now U.S. Pat. No. 5,325,765.

FIELD OF INVENTION

This invention relates to an imperforate beverage filter cartridge which is adapted to hermetically contain a beverage extract and which is yieldably pierceable, both to accommodate an injection of liquid into the cartridge for combination with the extract to produce a beverage, and to accommodate an outflow of the beverage.

DESCRIPTION OF THE PRIOR ART

There are a number of schemes for providing devices for making a single beverage server, such as a cup of coffee or tea. In one approach a disposable container fits on top of a cup and has a compartment for receiving a beverage extract such as coffee with a large reservoir on top into which a person must pour boiling water. These devices are disposable but expensive, the coffee is exposed to the air where it can easily get stale or contaminated, and they are not generally suitable for automatic coffee making or other beverage machines. Since the flow rate of beverage is generally slow, these devices are typically large relative to the volume of beverage dispensed. In addition, since these devices are designed to be used upright, only the bottom area is available for filtration flow and this contributes to the slowness of the filtration process. Attempts to overcome these shortcomings have met with indifferent success. In one construction a filter is provided in a sealed receptacle but included intermediate the receptacle and filter is a support member which functions to support the filter. When the filter is wetted it sags and conforms with the support member which has a hole in it to release the filtered beverage but otherwise blocks the output of the filter. Such a filter design used in an application where water is injected under pressure would provide low flow rates.

A general objective of the present invention is to provide an improved beverage filter cartridge which is small and compact yet has a high flow rate.

It is a further object of this invention to provide an improved beverage filter cartridge which is simple and has very few parts so it can be disposed of after a single use.

It is a further object of this invention to provide such an improved beverage filter cartridge whose filter is self supporting and does not collapse against the container even when wetted.

It is a further object of this invention to provide an improved imperforate beverage filter cartridge which is hermetically sealed for freshness and against contamination.

It is a further object of this invention to provide an improved imperforate beverage filter cartridge which can be yieldably pierced for input and output flow without puncturing the filter.

It is a further object of this invention to provide an improved beverage filter cartridge which maintains its integrity and that of the filter even when the cartridge is dually penetrated for inflow and outflow.

It is a further object of this invention to provide an improved beverage filter cartridge which even when the filter is wetted maintains a substantial volume between the filter and cartridge for safely receiving a penetrator and for enhancing filter flow-through.

SUMMARY OF INVENTION

The beverage filter cartridge of the present invention includes an impermeable imperforate hollow base closed at one end and having an access opening at the opposite end, with a self-supporting filter element permanently joined to an interior surface of the base. The filter is configured and dimensioned to divide the base into first and second chambers. A beverage extract is stored in the first chamber. An impermeable and imperforate cover is permanently joined in a hermetically sealed relationship to the base to close the access opening. Both the cover and base are yieldably pierceable, the cover to accommodate an injection of liquid into the first chamber for combination with the extract to produce a beverage, and the base to accommodate the outflow of the beverage from the second chamber.

In an alternative embodiment the cover may be domed convexly outward. The access opening of the base may include a flange and the cover may include a mating flange which establish the sealing engagement of the base and cover. The domed cover convexity may extend outwardly beyond the opening of the base. The filter and the base may both generally be truncated, non-congruent cones. The filter may be generally a cone shape and the base may be truncated cone shape. The filter may be a triangular prism with a circular base and the base may be truncated cone shape. The base may be made of polystyrene, ethylene vinyl alcohol, and polyethylene. The cover may be made of the same material. The filter may be made of a lightweight, two-phase heat-sealable paper of cellulosic synthetic fibers. These synthetic fibers may be PVC or polypropylene. The filter element may terminate in a reduced apex portion spaced from the bottom of the base to define an enlarged second chamber for receiving the piercing element in the lower portion of the base without subjecting the filter element to penetration.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENTS

Figure 1:
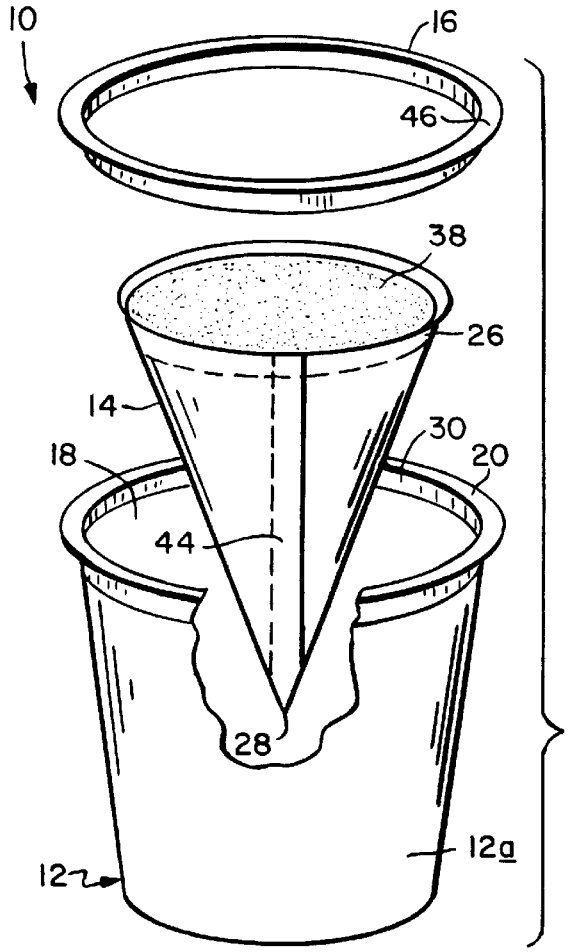
FIG. 1 is a three-dimensional exploded view of a beverage filter cartridge according to this invention with a portion of the base broken away.
Figure 2:
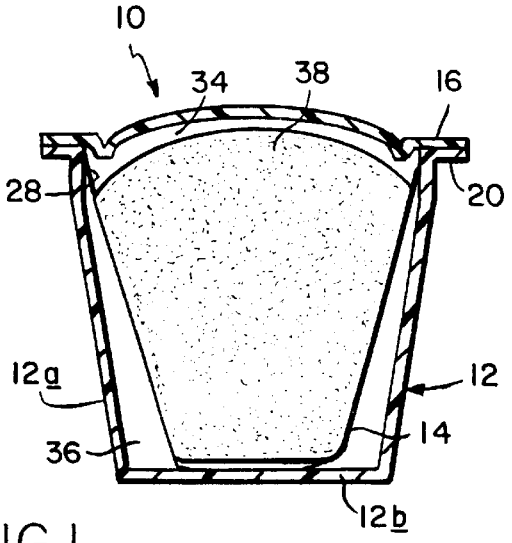
FIG. 2 is a vertical sectional view of the cartridge of FIG. 1 shown in an assembled state.

As illustrated the beverage filter cartridge 10 of the present invention includes an impermeable, imperforate, yieldably pierceable hollow base 12, a filter element 14 and an impermeable imperforate yieldably pierceable cover 16. The base is preferably cup-shaped, with a gradually tapering truncated conical side wall 12*a* closed at one end by a substantially flat bottom wall 12*b* and defining a circular access opening 18 at the opposite end. The sidewall includes a radially outwardly protruding lip surrounding the access opening. The base 12 is typically formed from a polymeric laminate. One example of a base material is Product No. C150 available from Winpak Portion Pack of Bristol, Pa. This material is a coextruded composite barrier sheet consisting of polystyrene, polyethylene, EVOH and adhesive. The barrier sheet is then thermoformed into the shape of a cup. The techniques for forming the sheet and cup are well known in the art. The base 12 is yieldably pierceable with an instrument such as a needle 22 or other penetrator to provide an exit for a beverage to be dispensed.

Figure 3B:
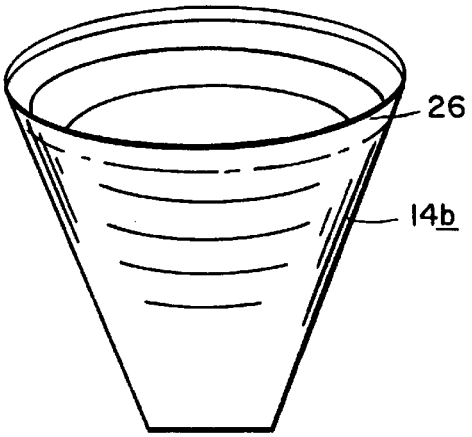
FIG. 3B is a view similar to FIG. 3A of an alternative truncated conical shaped filter.
Figure 3A:
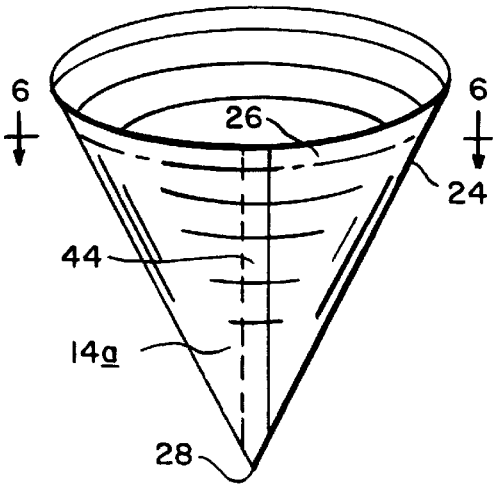
FIG. 3A is a perspective view of the filter of FIGS. 1 and 2.

A self-supporting wettable filter element 14 is disposed in the base 12 and is permanently joined to an interior surface of the side wall 12*a* of the base. The filter is preferably in the shape of an inverted hollow cone 24 having a curved wall tapering evenly from a circular rim 26 surrounding an open upper end to a closed lower end as shown in FIG. 3A. The filter element 14 is placed in the base 12 so that the apex 28 of the cone 24 is supported on and slightly flattened by the bottom wall 12*b* of the base 12. This enlarges the volume within the cone and provides beneficial support for the filter element 14.

Figure 5:
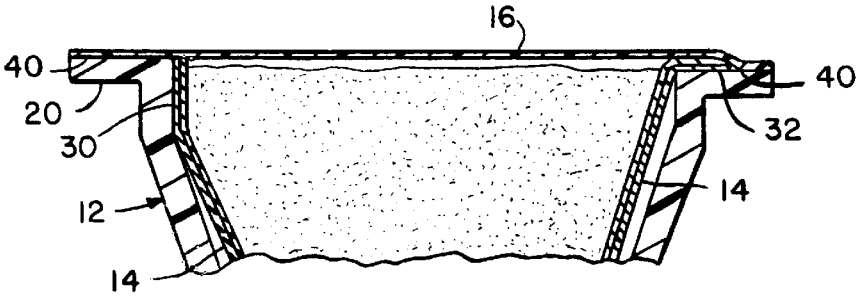
FIG. 5 is an enlarged split cross-section of the upper portion a beverage filter cartridge illustrating alternative embodiments of the cartridge.

As depicted by the left-hand portion of FIG. 5, preferably the circular rim 26 of the filter element 14 is heat sealed to the interior of the side wall 12*a* of the base 12 at a location 30 adjacent to the access opening 18. Alternatively, as depicted at the right-hand portion of FIG. 5, the rim 26 of the filter element 14 can be heat sealed as at 32 to a portion of the lip 20 of the base 12.

The filter element 14 is configured and dimensioned to divide the base into two chambers 34, 36. In the first chamber 34, an extract 38 of the beverage that is to be made, such as coffee, is stored. Because the filter 14 is flattened on the bottom of the base, a considerably greater amount of extract 38 can be accommodated by the filter 14. The second chamber 36 has a volume for accessing the beverage outflow through the filter 14 after the beverage has been made by combining liquid with the extract 38. There is ample room in the second chamber 36 so that a penetrator 22 which yieldably pierces the base 12 will not rupture or otherwise deform the filter 14.

A yieldably pierceable impermeable and imperforate cover 16 is permanently joined as at 40 in a hermetically sealed relationship with the lip of the base 12, closing the opening 18 to form an imperforate, impermeable cartridge 10. The cover 16 is yieldably pierceable with an instrument such as a tubular needle 42 or other penetrator through which hot water is delivered for combination with the extract 38 in the first chamber 34. The cover 16 is preferably a laminate of nylon, aluminum and a heatseal lacquer used to bond the aluminum to the polyethylene of the base. A typical cover material is 15 micron OPA/ADH/20 micron ALU/LPP75 supplied by Hueck Foils, Inc., of Eatontown, N.J. The cover 16 is die cut to a size equal to or slightly smaller than that of the lip 20 of the base 12.

The filter element 14 may be made of a lightweight, two-phase heat sealable paper of cellulosic and synthetic fibers such as the "Superseal" Teabag Paper supplied by J. R. Crompton's of Gainesville, Ga. The synthetic fibers may be PVC or polypropylene so that they are compatible with the material of the base and are therefore easily sealed to the base using heat, ultrasonic energy or microwave energy. In addition, the material of the filter is such that the filter 14 is totally self-supporting. Even when the filter 14 is wetted, it will not collapse or sag against the inner wall 12*a* of the base 12.

Figure 6:
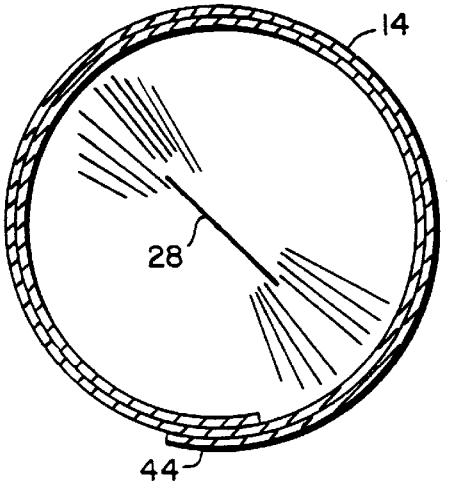
FIG. 6 is a sectional view taken along line 6–6 of FIG. 3A.

The filter element 14 is die cut from a sheet of material to include three quarters of a circle and then rolled twice to form a double-walled cone in which the edges are heat sealed along seam 44 to the overlapping portion of the filter element. The double-walled configuration of the cone can best be seen in FIG. 6. The filter element 14 can also be formed into a truncated cone, see FIG. 3B, or a triangular prism which fans out and blends into a circular base, however, these shapes are more costly to form.

Figure 4:
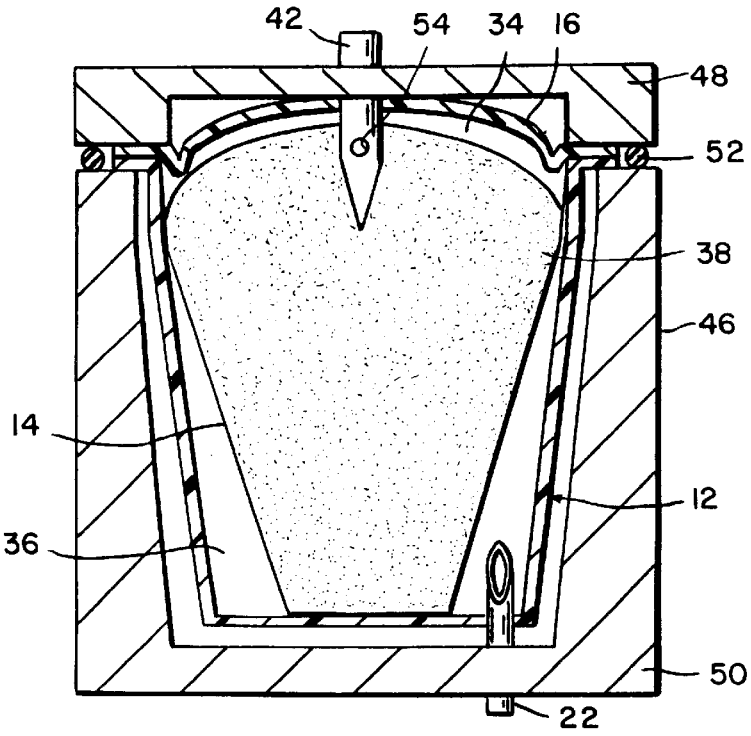
FIG. 4 is a view showing the beverage filter cartridge installed in a brewing machine.

As illustrated in FIG. 4, cartridge 10 is well adapted for use in an automatic machine such as a coffee brewing machine where it will be delivered to and gripped in a housing 46 having an upper part 48 and a lower part 50 sealingly engaged at seal 52 by a portion of the machine not shown. Upper part 48 includes a penetrator or needle 42 which yieldably penetrates cover 16 to provide pressurized hot water through hole 54 to coffee extract 38 in filter 14. A second penetrator or needle 22 is yieldably pushed through the bottom 12*b* of base 12 to receive the outflow of the coffee beverage and dispense it to a cup or container.

In the coffee packaging industry, before sealing the package it is standard practice to replace the oxygen in the package with nitrogen. This practice may be included in the manufacturing of the beverage filter cartridge disclosed herein.

Although specific features of the invention are shown in some drawings and not others, this is for convenience only as some feature may be combined with any or all of the other features in accordance with the invention.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

What is claimed is:

1. A beverage filter cartridge comprising:

an impermeable hollow base, said base having a closed substantially flat circular bottom with a continuous truncated conical side wall extending upwardly therefrom to a radially outwardly protruding lip surrounding a circular access opening;

a self-supporting filter element received in said base, said filter element being permanently joined to an interior surface of said side wall at a location adjacent to said access opening and being configured and positioned to subdivide the interior of said base into first and second chambers, said first chamber being arranged to store a beverage extract received through said access opening; and an impermeable circular cover closing said access opening and being permanently joined in a sealed relationship to said lip to cooperate with said base in forming an imperforate cartridge, said cover being yieldably pierceable to accommodate an injection of liquid into said first chamber for combination with said extract to produce a beverage, said filter being adapted to accommodate a flow therethrough of said beverage into said second chamber, and said base being yieldably pierceable to accommodate an outflow of said beverage from said second chamber to the exterior of said cartridge.

2. The beverage filter cartridge of claim 1 wherein said filter element is an inverted hollow cone having a curved wall tapering evenly from a circular rim surrounding an open upper end to a closed lower end, said circular rim being heat sealed to the interior surface of said wall.

3. The beverage filter cartridge of claim 2 wherein the closed lower end of said filter element is supported on and flattened by said bottom wall.

4. The beverage filter cartridge of claim 1 wherein said base is thermoformed from a laminate of a coextruded barrier sheet consisting of polystyrene, polyethylene, EVOH and adhesive.

5. The beverage filter cartridge of claim 1 wherein said cover is a laminate of nylon, aluminum and heatseal lacquer.

6. A beverage filter cartridge comprising:

an impermeable hollow base, said base having a circular closed bottom with a wall diverging upwardly therefrom to a radially outwardly protruding lip surrounding a circular access opening;

a filter element received in said base, said filter element being permanently joined to an interior surface of said wall at a location adjacent to said access opening and being configured and positioned to subdivide the interior of said base into first and second chambers, said first chamber being arranged to store a beverage extract received through said access opening; and an imperforate circular cover closing said access opening and being permanently joined in a sealed relationship to said lip to cooperate with said base in completing the formation of said cartridge, said cover being yieldably pierceable to accommodate an injection of liquid into said first chamber for combination with said extract to produce a beverage, said filter being adapted to accommodate a flow therethrough of said beverage into said second chamber, and said base being yieldably pierceable to accommodate an outflow of said beverage from said second chamber to the exterior of said cartridge.

* * * * *